US006881158B2

(12) United States Patent
Yang et al.

(10) Patent No.: US 6,881,158 B2
(45) Date of Patent: Apr. 19, 2005

(54) WEIGHT NUMBER FOR A GOLF CLUB HEAD

(75) Inventors: Shun-Fa Yang, Kaohsiung Hsien (TW); Chan-Tung Chen, Kaohsiung (TW); Yan-Zheng Su, Tainan Hsien (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 13 days.

(21) Appl. No.: 10/625,602

(22) Filed: Jul. 24, 2003

(65) Prior Publication Data

US 2005/0020377 A1 Jan. 27, 2005

(51) Int. Cl.[7] ..... A63B 53/04
(52) U.S. Cl. ..... 473/324; 473/335; 473/349
(58) Field of Search ..... 473/324–350

(56) References Cited

U.S. PATENT DOCUMENTS 4,429,879 A * 2/1984 Schmidt ..... 473/346
4,465,221 A * 8/1984 Schmidt ..... 228/125
5,669,825 A * 9/1997 Shira ..... 473/324
5,938,540 A * 8/1999 Lu ..... 473/288
5,967,905 A * 10/1999 Nakahara et al. ..... 473/345
6,406,382 B1 * 6/2002 Deshmukh et al. ..... 473/349
6,524,198 B1 * 2/2003 Takeda ..... 473/338
6,617,537 B1 * 9/2003 Chiu et al. ..... 219/121.14

* cited by examiner

*Primary Examiner*—Sebastiano Passaniti
(74) *Attorney, Agent, or Firm*—Birch, Stewart, Kolasch & Birch, LLP

(57) ABSTRACT

A golf club head includes a golf club head body and a weight member. The golf club head member has a recession in which the weight member is mounted. The weight member is securely mounted in the recession of the golf club head body by a welding procedure that uses a welding material. The weight member is made of a material having a melting point higher than that of the golf club head body, avoiding melting of the weight member during the welding procedure. Only a portion of the golf club head body fuses with the welding material while using the welding material for proceeding with the welding procedure for the weight member.

10 Claims, 6 Drawing Sheets

WEIGHT NUMBER FOR A GOLF CLUB HEAD

BACKGROUND OF THE INVENTION

1. Field of the Invention

The present invention relates to a weight member for a golf club head.

2. Description of Related Art

A typical golf club head body for a golf club head usually adopts a material having a high coefficient of restitution to allow a golf ball stricken by the golf club to fly through a longer distance. Since a material with a high vibration-absorbing capacity may absorb most part of vibration of the golf club generated as a result of striking a golf ball, titanium or titanium alloy is often selected as the material for reducing the vibration transmitted to the hands of the golfer even if the golf ball is not hit by the sweet spot of the striking plate of the golf club head. Nevertheless, since titanium has a density of about 4.51 g/cm$^3$, the center of gravity of the golf club, which is a product of assembling a shaft with a golf club head that uses titanium (such as 6-4 Ti) as the main composition, is not in an appropriate location. A solution to this problem is inserting a weight member into the golf club head to adjust the location of the center of gravity.

FIG. 1 of the drawings illustrates a golf club head body 1 having a recession 11 and a weight member 2 to be embedded by tight fitting into the recession 11. Then, surface finishing is performed on the golf club head body 1 and the weight member 2 to provide a golf club head. The weight member 2 is made of a material that has a high density and that is rigid and fragile. The precision formation of the weight member 2 for mating with the recession 11 of the golf club head body 1 is difficult, and the weight member 2 is apt to break while pressing the weight member 2 into the golf club head body 1. Further, a gap between the recession 11 and the weight member 2 is generated after the surface finishing and thus requires subsequent filling of the gap. The tight engagement between the surfaces of the golf club head body 1 and the weight member 2 are adversely affected. Further, since the filling material for filling the gap between the recession 11 and the weight member 2 is a high molecular polymer, the weight member 2 tends to disengage from the golf club head body 1 after long-term striking of golf balls for a period of time.

FIG. 2 shows another conventional golf club head, wherein a weight member 4 is placed in a recession 31 of a golf club head body 3 and then fixed in place by welding. Although the engaging strength between the golf club head body 3 and the weight member 4 is improved by welding, the high temperature generated during welding causes melting of both the golf club head body 3 and the weight member 4, variation in the welding pool disturbance, welding speed, electric current, and heat transmitted to the golf club head body 3 and the weight member 4 affects the depth of the welding bead 32. As a result, the welding bead 32 is irregular in shape, resulting in difficult quality control and adversely affecting the appearance. Further, in a case that the golf club head body 3 is made of titanium or titanium alloy, the welding heat checking often occurs, as titanium has a poor welding effect with other metal. In particular, titanium can only be welded with zirconium, niobium, tantalum, and hafnium.

OBJECTS OF THE INVENTION

An object of the present invention is to provide a golf club head including a golf club head body and a weight member made of a material having a melting point higher than that of the golf club head body, avoiding melting of the weight member during a welding procedure for fixing the weight member in the golf club head body. The appearance of the golf club head is aesthetic, and the process quality control is improved.

Another object of the present invention is to provide a golf club head including a golf club head body and a weight member received in a recession of the golf club head body, wherein a gap between the golf club head body and the weight member is filled by a welding material used during the welding procedure, thereby preventing the weight member from disengaging from the golf club head body and improving the quality of the golf club head.

SUMMARY OF THE INVENTION

To achieve the aforementioned objects, the present invention provides a golf club head comprising a golf club head body and a weight member. The golf club head member has a recession in which the weight member is mounted. The weight member is securely mounted in the recession of the golf club head body by means of a welding procedure using a welding material. The weight member is made of a material having a melting point higher than that of the golf club head body, avoiding melting of the weight member during the welding procedure. Only a portion of the golf club head body fuses with the welding material while using the welding material for proceeding with the welding procedure for the weight member.

Other objects, advantages and novel features of this invention will become more apparent from the following detailed description when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
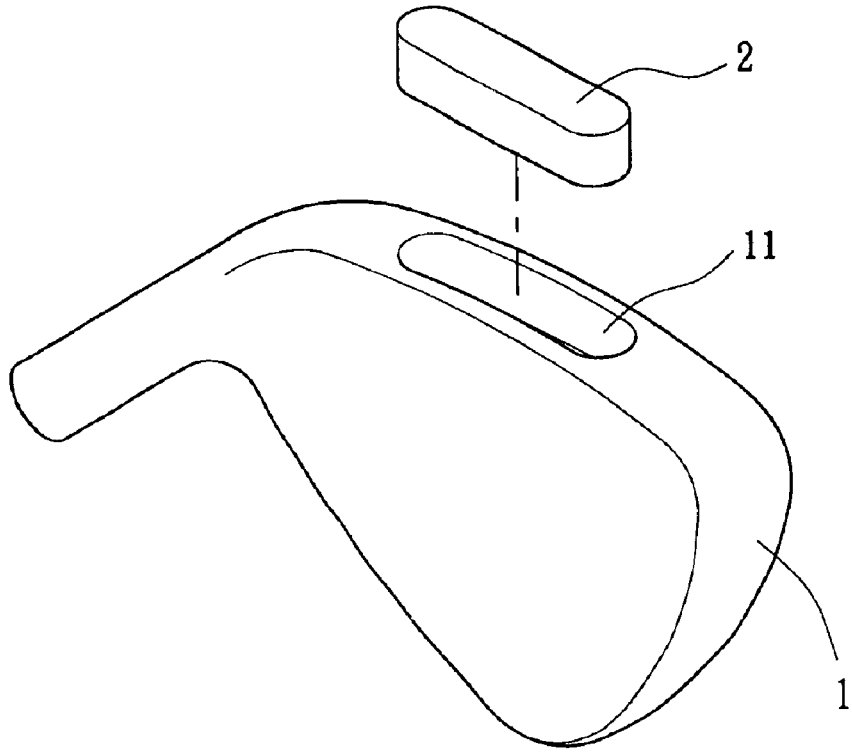
FIG. 1 PRIOR ART
FIG. 1 is an exploded perspective view of a conventional golf club head.
Figure 2:
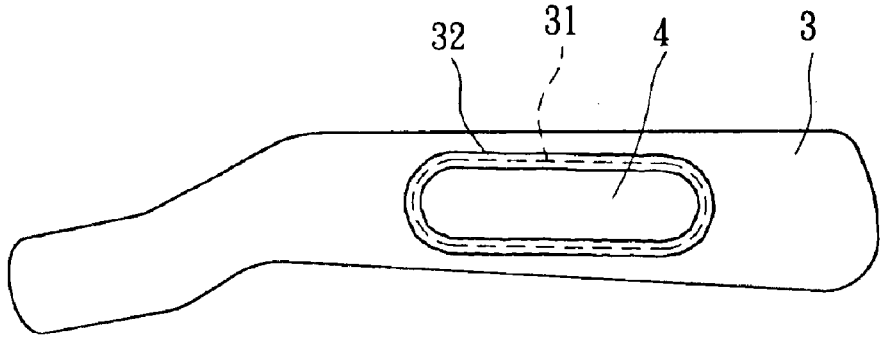
FIG. 2 PRIOR ART
FIG. 2 is a top view of another conventional golf club head.

Preferred embodiments of the present invention are now to be described hereinafter in detail, in which the same reference numerals are used in the preferred embodiments for the same parts as those in the prior art to avoid redundant description.

Figure 3:
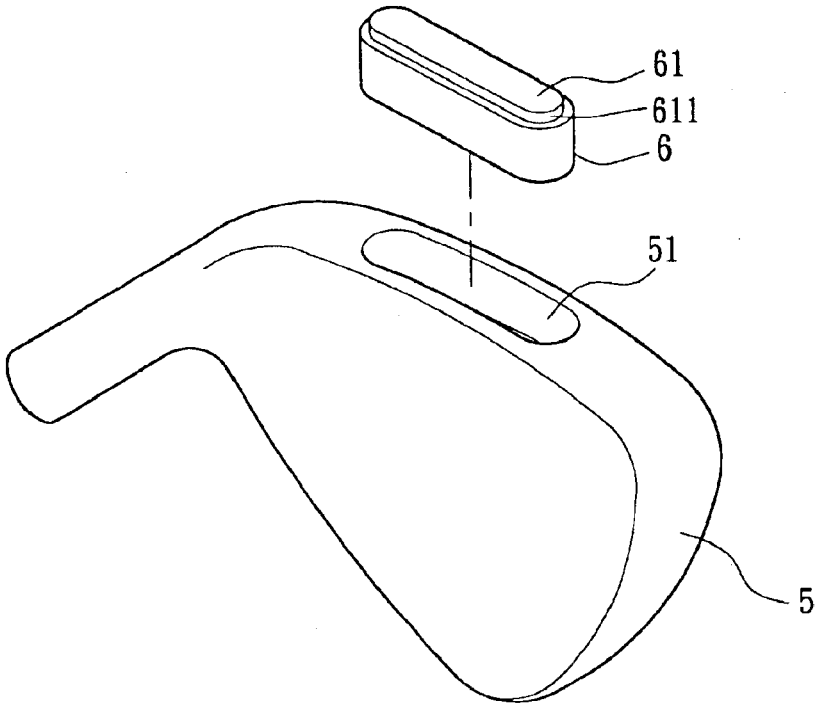
FIG. 3 is an exploded perspective view of a golf club head in accordance with the present invention.

Referring to FIG. 3, an embodiment of a golf club head in accordance with the present invention includes a golf club head body 5 and a weight member 6. The golf club head body 5 includes a recession 51 for receiving the weight member 6. The weight member 6 includes a protrusion 61 on a side thereof, forming a shoulder 611. The golf club head body 5 may be made by carbon steel of S20C, 8620, or SUS 304. The weight member 6 is made of a material having a high melting point, such as tungsten (W) having a melting point of 3410° C. and a density of 19.3 g/cm$^3$, tantalum (Ta) having a melting point of 2996° C. and a density of 16.65 g/cm$^3$, molybdenum (Mo) having a melting point of 2610° C. and a density of 10.2 g/cm$^3$, niobium (Nb) having a melting point of 2468° C. and a density of 8.57 g/cm$^3$. Alternatively, an alloy using other metal material having a high melting point can be used. The material having a high melting point could not melt in an ordinary high-frequency waves melter. Thus, the weight member 6 is preferably made by means of powder metallurgy.

Figure 4:
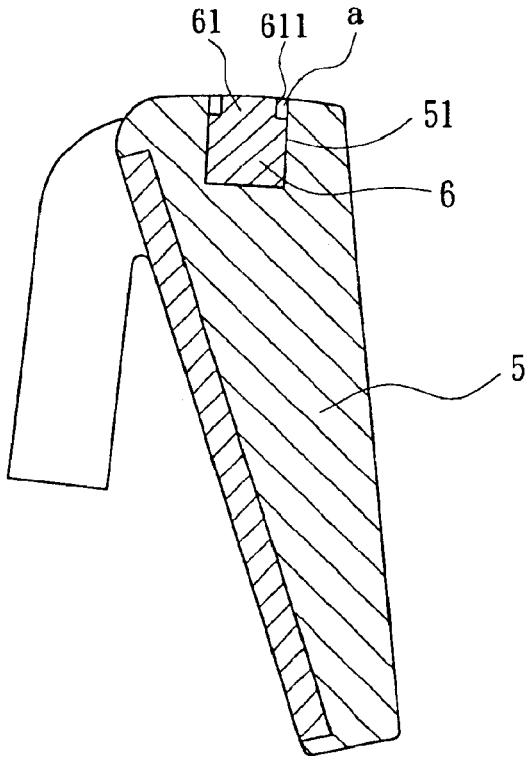
FIG. 4 is a sectional view of the golf club head in accordance with the present invention.

Referring to FIG. 4, when the protrusion 61 of the weight member 6 is received in the recession 51 of the golf club head body 5, a channel "a" is defined between the recession 51 and the protrusion 61 of the weight member 6.

Figure 5:
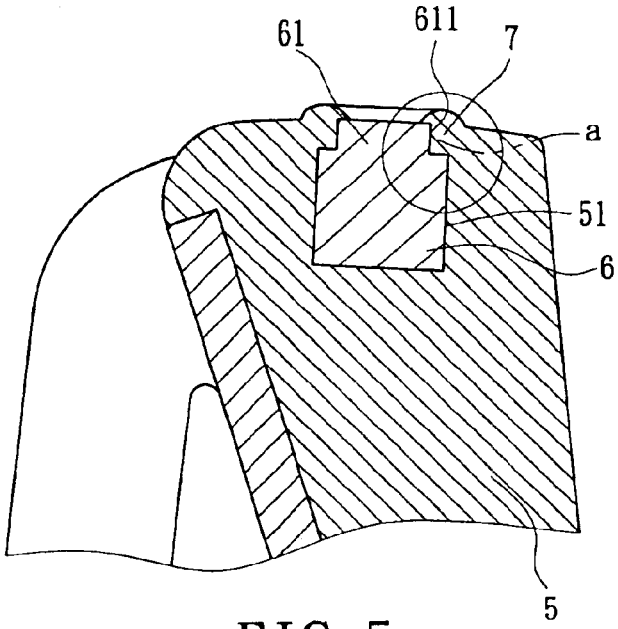
FIG. 5 is an enlarged sectional view of the golf club head in accordance with the present invention after welding.
Figure 6:
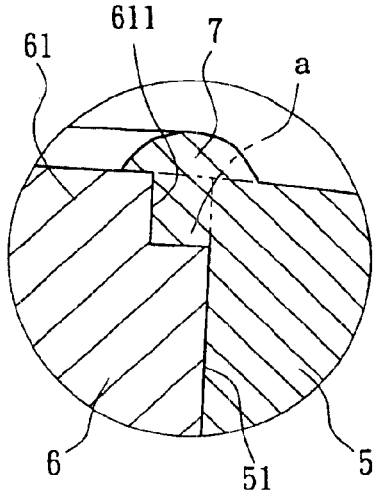
FIG. 6 is an enlarged view of a circled portion of FIG. 5.

Referring to FIGS. 5 and 6, a welding material (filling material) 7 is placed into the channel "a" between the recession 51 of the golf club head body 5 and the protrusion 61 of the weight member 6. The welding material 7 can be the same as that of the golf club head body 5. Alternatively, the welding material may include the main compositions for forming the golf club head body 5. In a case that the material of the golf club head body 5 is consisted of carbon 0.07 wt %, silicon 1.0 wt %, manganese 0.7 wt %, phosphor 0.035 wt %, sulfur 0.03 wt %, copper 2.5–3.2 wt %, nickel 3.6–4.6 wt %, and chromium 15.5–17.7 wt %, with iron being the remaining portion, the welding material includes silicon (Si), manganese (Mn), copper (Cu), nickel (Ni), Chromium (Cr), and iron (Fe). Then, a welding procedure such as tungsten inert gas arc welding or other welding process can be performed to allow the welding material 7 to be melted and fills the channel "a". Since the weight member 6 is made of a material or alloy having a high melting point and since the welding material 7 includes the composing metals the same as those for the golf club head 5, when fusing the golf club head body 5 and the welding material 7, the weight member 6 are not melted while the golf club head body 5 melts partially (see the phantom line in FIG. 6).

Figure 7:
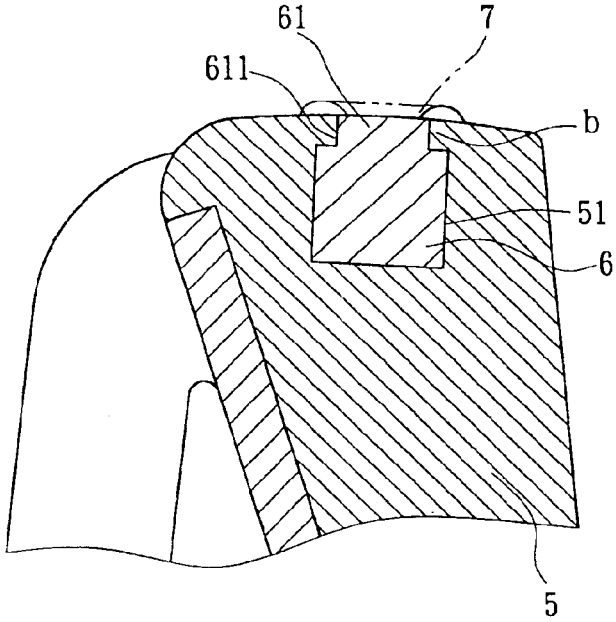
FIG. 7 is an enlarged sectional view of the golf club head in accordance with the present invention after surface finishing.
Figure 8:
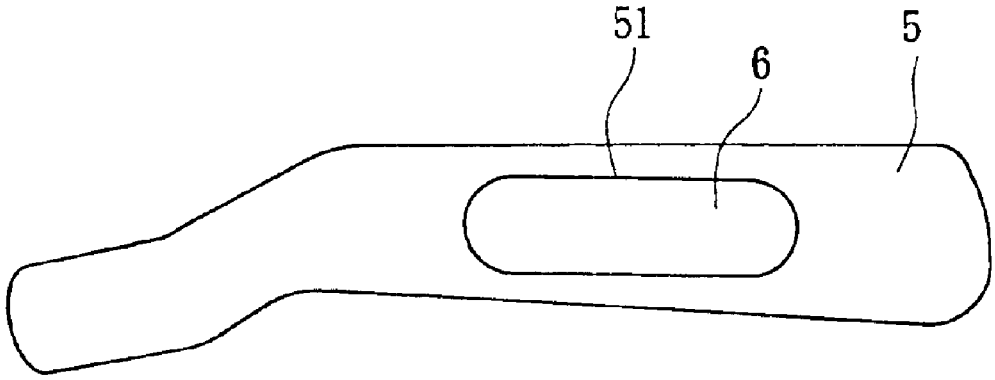
FIG. 8 is a top view of the golf club head in accordance with the present invention after surface finishing.

Referring to FIGS. 7 and 8, when the molten portions of the golf club head body 5 and the welding material 7 cool and solidify, the welding material 7 and the golf club head body 5 join each other and form an engaging portion "b". In this case, since the golf club head body 5 and the welding material 7 use the same material, they are not affected by the dilution ratio during welding; namely, they fuse together as a one-piece member. The engaging portion "b" fixes the weight member 6 in the recession 51 of the golf club head body 5. After welding, the welding material 7 forms a bulge (see the phantom lines) on the surfaces of the golf club head body 5 and the weight member 6. The bulge can be removed by subsequent finishing (e.g., grinding), providing a flat surface for the golf club head body 5. Since the weight member 6 (including the protrusion 61) does not melt when the welding material 7 fuses, no fusion occurs between the golf club head body 5 and the weight member 6. Thus, a clear contour of the weight member 6 can still be seen on the golf club head body 5, as illustrated in FIG. 8. Further, the engaging portion "b" provides a tight and seamless engaging face between the golf club head body 5 and the weight member 6, which not only allows the weight member 6 to be tightly engaged in the recession 51 of the golf club head body 5 but also improves the engaging strength between the golf club head body 5 and the weight member 6.

Figure 9:
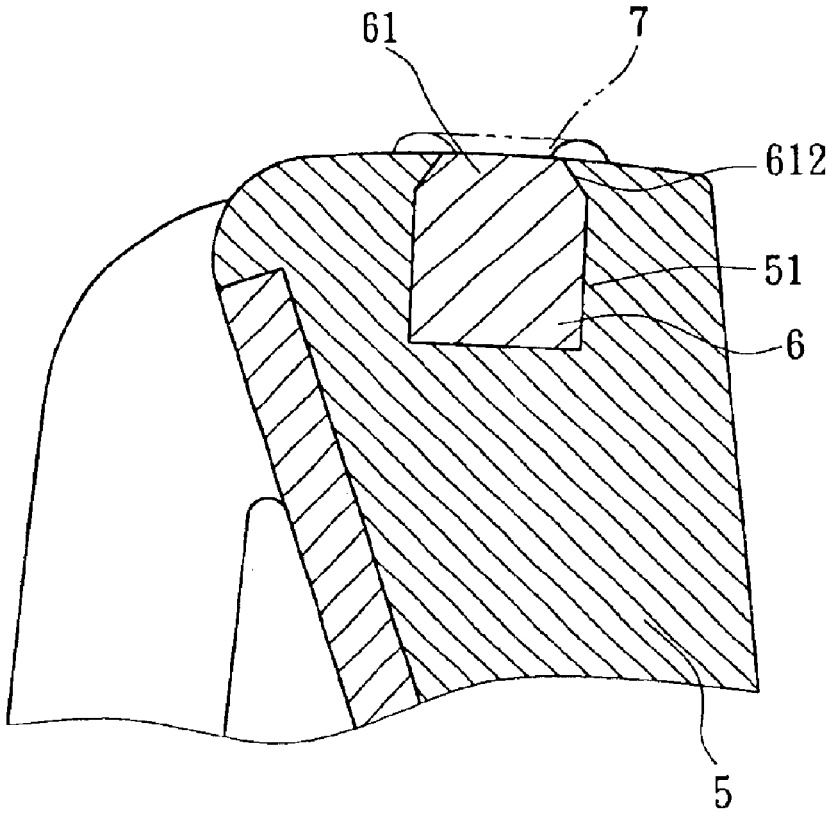
FIG. 9 is a view similar to FIG. 7, illustrating a modified embodiment of the golf club head in accordance with the present invention.

FIG. 9 illustrates a modified embodiment of the invention, wherein like reference numerals denote like elements, and only the difference between the modified embodiment and the first embodiment is disclosed to avoid redundancy. In this embodiment, the golf club head includes a golf club head body 5 and a weight member 6. The golf club head body 5 includes a recession 51 for receiving the weight member 6. The weight member 6 includes a protrusion 61 integrally formed on a side thereof, wherein the protrusion 61 has a peripheral wall 612 that is inclined upward. When the weight member 6 is placed in the recession 51, a channel "a" is formed between the recession 51 and the peripheral wall 612 of the protrusion 61. After welding, the welding material 7 fills the channel "a" and forms a bulge on the surface of the golf club head body 5. The bulge can be ground off by subsequent surface finishing.

Figure 10:
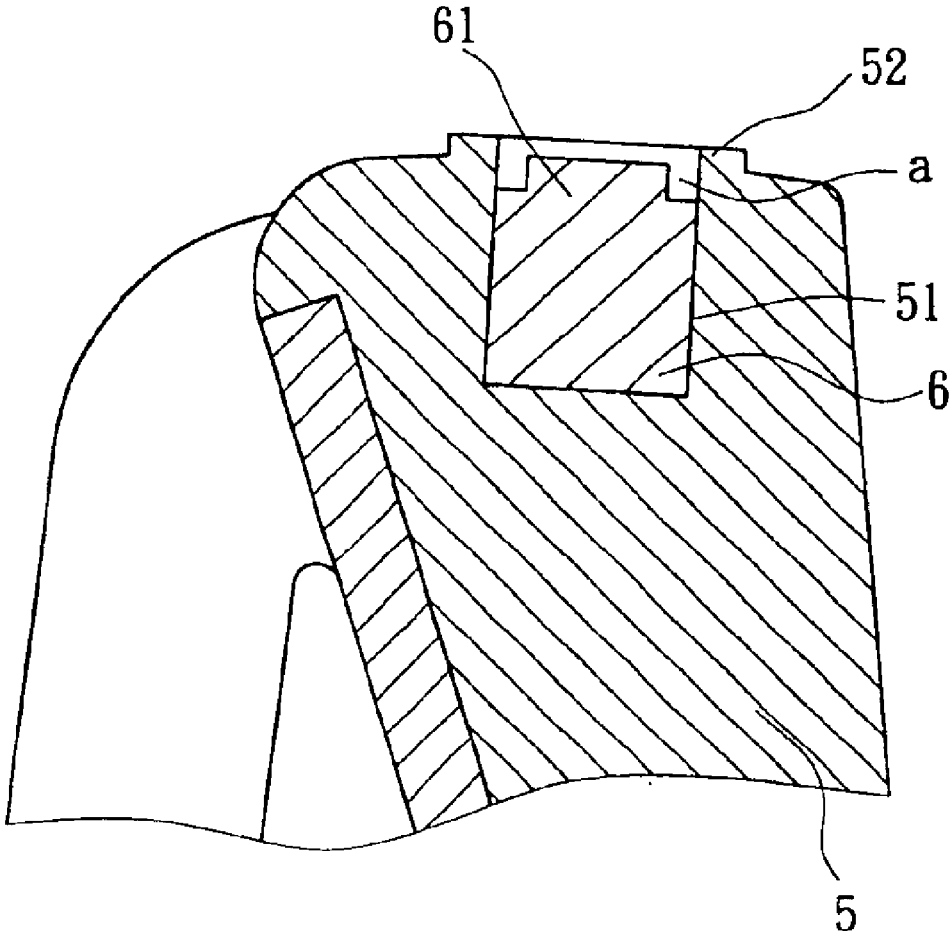
FIG. 10 is a view similar to FIG. 7, illustrating another modified embodiment of the golf club head in accordance with the present invention.
Figure 11:
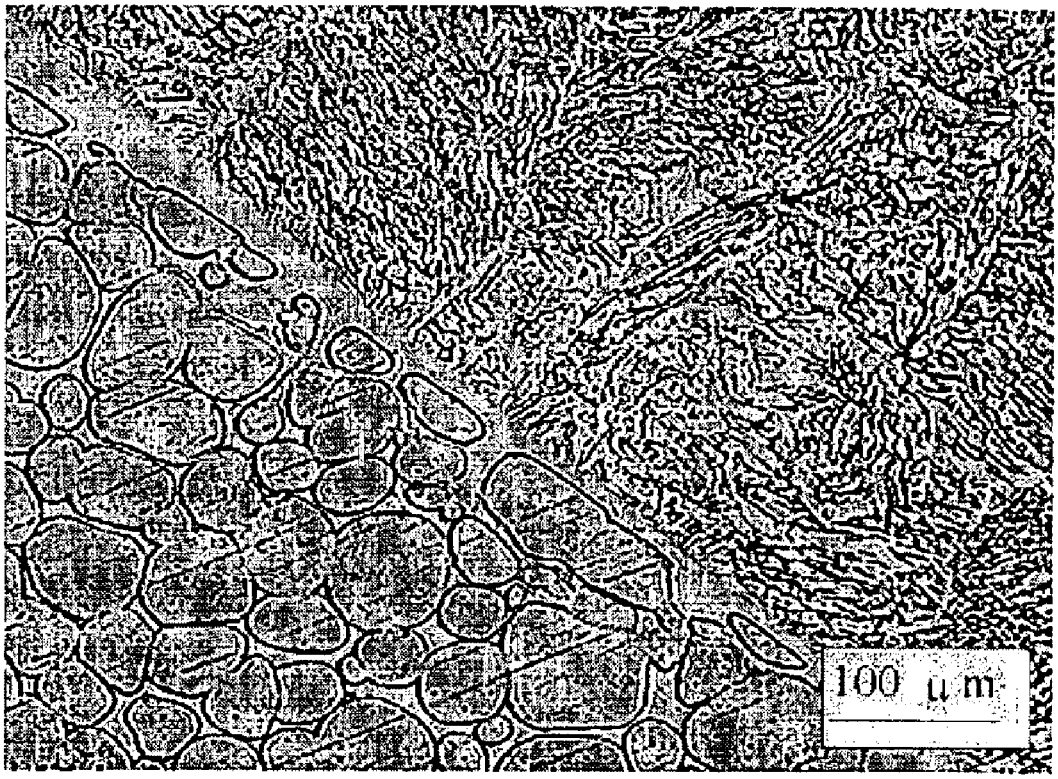
FIG. 11 is a metallographic view illustrating the welding boundary between the welding member and stainless in the embodiment of FIG. 10.

FIG. 10 illustrates another modified embodiment of the invention, wherein like reference numerals denote like elements. FIG. 11 is a metallographic view illustrating the welding boundary between the welding member and stainless in the embodiment of FIG. 10. Only the difference between the modified embodiment and the first embodiment is disclosed to avoid redundancy. In this embodiment, the golf club head includes a golf club head body 5 and a weight member 6. The golf club head body 5 includes a recession 51 for receiving the weight member 6 and a flange 52 that is integrally formed on a peripheral wall portion delimiting an opening of the recession 51. The weight member 6 includes a protrusion 61 on a side thereof. The flange 52 is of a material the same as that of the golf club head body 5 and acts as a welding material during the welding procedure. When the weight member 6 is placed in the recession 51, a channel "a" is formed between a peripheral wall delimiting the recession 51 and the protrusion 61 of the weight member 6. Further, the golf club head body 5 is preferably made of titanium or of a material using titanium as the main composition (such as 6-4 Ti). Alternatively, the golf club head body 5 can be made of low carbon steel or low alloy steel. Thus, the weight member 6 does not melt when a portion of the golf club head body 5 and the welding material 7 fuse with each other. As a result, no intermetallics are formed, and heat checking of welding is avoided.

During the welding procedure, the flange 52 melts and forms the welding material 7 that fills the channel "a" (c.f. FIGS. 5 and 6). An engaging portion "b" is formed in the channel "a" after solidification and thus fixes the weight member 6 in the recession 51 of the golf club head body 5. Finally, the surfaces of the golf club head body 5 and the weight member 6 are finished.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A golf club head comprising:

a golf club head body including a recession; and a weight member mounted in said recession of said golf club head body, said weight member being securely mounted in said recession of said golf club head body by a welding procedure using a part of a welding material melting from said recession of said golf club head body in the welding step, said weight member being made of a material having a melting point higher than that of said golf club head body, avoiding melting of said weight member during said welding procedure, only a portion of said golf club head body fusing with said welding material to provide an engaging flange while using said welding material for proceeding with said welding procedure for said weight member, said weight member includes a protrusion and an engaging portion thereof correspondingly engaged with said engaging flange of said golf club head after the welding step.

2. The golf club head as claimed in claim 1, wherein said weight member is made of a material including tungsten, tantalum, molybdenum, and niobium.

3. The golf club head as claimed in claim 1, wherein said weight member is made of a material including tungsten, tantalum, molybdenum, niobium, and a small amount of other metals and formed by powder metallurgy.

4. The golf club head as claimed in claim 1, wherein said gold club head body is made of one of titanium and an alloy using titanium as its main composition.

5. The golf club head as claimed in claim 1, wherein said golf club head body is made of one of low carbon steel and low alloy steel.

6. The golf club head as claimed in claim 1, wherein said golf club head is made of stainless steel.

7. The golf club head as claimed in claim 1, wherein said golf club head includes a flange acting as said welding material.

8. The golf club head as claimed in claim 1, wherein said welding material is the same as a material for said golf club head body.

9. The golf club head as claimed in claim 1, wherein said protrusion forms a shoulder to constitute said engaging portion on said weight member.

10. The golf club head as claimed in claim 1, wherein said protrusion of said weight member includes a peripheral inclined face to constitute said engaging portion.

* * * * *